US007839398B2

(12) United States Patent
Li et al.

(10) Patent No.: US 7,839,398 B2
(45) Date of Patent: Nov. 23, 2010

(54) GATE DRIVING CIRCUIT AND POWER CONTROL CIRCUIT

(75) Inventors: Ming-Xian Li, Taoyuan County (TW); Chih-Min Yu, Taoyuan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 705 days.

(21) Appl. No.: 11/863,284

(22) Filed: Sep. 28, 2007

(65) Prior Publication Data

US 2008/0316195 A1 Dec. 25, 2008

(30) Foreign Application Priority Data

Jun. 21, 2007 (TW) ..... 96122294 A

(51) Int. Cl.
*G09G 5/00* (2006.01)

(52) U.S. Cl. ..... 345/212; 345/204; 345/211

(58) Field of Classification Search ..... 345/204, 345/211–214, 98; 327/291, 589; 326/83; 315/307

See application file for complete search history.

(56) References Cited

U.S. PATENT DOCUMENTS 6,373,479 B1 4/2002 Moon
6,445,210 B2 * 9/2002 Nojiri ..... 326/68
6,839,046 B1 * 1/2005 Orisaka et al. ..... 345/98
7,015,904 B2 3/2006 Kim
7,042,266 B2 * 5/2006 Takahashi ..... 327/288
7,460,099 B2 * 12/2008 Kubota et al. ..... 345/98
7,719,510 B2 * 5/2010 Guo et al. ..... 345/100
7,734,940 B2 * 6/2010 Yamazaki ..... 713/322
2002/0083352 A1 * 6/2002 Fujimoto et al. ..... 713/300
2003/0168671 A1 * 9/2003 Huang et al. ..... 257/157
2004/0155693 A1 * 8/2004 Ito et al. ..... 327/333
2006/0092883 A1 5/2006 Lee et al.
2006/0244709 A1 * 11/2006 Lin ..... 345/100
2007/0103458 A1 * 5/2007 Kawahigashi ..... 345/204
2007/0210780 A1 * 9/2007 Kataoka ..... 323/285
2007/0285381 A1 * 12/2007 Gong et al. ..... 345/102
2007/0288780 A1 * 12/2007 Yamazaki ..... 713/322
2008/0165101 A1 * 7/2008 Kim ..... 345/87

* cited by examiner

*Primary Examiner*—Nitin Patel
(74) *Attorney, Agent, or Firm*—Jianq Chyun IP Office

(57) ABSTRACT

A gate driving circuit and a power control circuit are disclosed. The gate driving circuit includes a gate driver and the power control circuit. The gate driver is adapted for receiving a starting signal and sequentially outputting a plurality of scan signals accordingly. The power control circuit includes a delay circuit, a level shifter and a switch unit. The delay circuit is adapted for receiving and delaying the starting signal for a predetermined period and then outputting the delayed starting signal. The level shifter receives and adjusts a voltage level of the delayed starting signal, and outputs a starting voltage accordingly. The switch unit provides the first power to the gate driver after being delayed for the predetermined period according to the starting voltage.

12 Claims, 6 Drawing Sheets

GATE DRIVING CIRCUIT AND POWER CONTROL CIRCUIT

CROSS-REFERENCE TO RELATED APPLICATION

This application claims the priority benefit of Taiwan application serial no. 96122294, filed Jun. 21, 2007. All disclosure of the Taiwan application is incorporated herein by reference.

BACKGROUND OF THE INVENTION

1. Field of the Invention

The present invention generally relates to a gate driving circuit, and more particularly, to a power control circuit adapted for protecting a gate driving circuit.

2. Description of Related Art

Gate driving circuits are known as critical components of thin film transistor liquid crystal displays (TFT-LCDs). In a TFT-LCD, a gate driving circuit is responsible for turning on/off TFTs on each row of pixels in the TFT-LCD panel. In order to avoid burning suddenly of the gate driving circuit, a typical approach is to delay the input timing of a partial power inputting to the gate driving circuit for a certain amount.

FIG. 1 is a block diagram illustrating a conventional approach for protecting a gate driving circuit. Referring to FIG. 1, a power supply 11 is employed for outputting a first power VDDG and a second power VEEG. The first power VDDG is adapted for providing a voltage level to a gate driving circuit 13 for controlling each row of pixels in the TFT-LCD panel to turn on. The second power VEEG is adapted for providing a voltage level to a gate driving circuit 13 for controlling each row of pixels in the TFT-LCD panel to turn off. A delay circuit 12 is coupled between the power supply 11 and the gate driving circuit 13, and is composed of resistors $R_1$ through $R_4$, TFTs $Q_1$ and $Q_2$, and a capacitor C. The delay circuit 12 is adapted for delaying the first power VDDG for a certain input timing, and thereafter providing the same to the gate driving circuit 13 for use.

FIG. 2 is a power timing chart illustrating the powers VDDG and VEEG received by the gate driving circuit 13 as shown in FIG. 1. Referring to FIGS. 1 and 2 together, when the power supply 11 simultaneously outputs the first power VDDG and the second power VEEG, the delay circuit 12 directly provides the second power VEEG to the gate driving circuit 13 for use, i.e., the second power VEEG is not delayed thereby. In addition, the second voltage VEEG is being divided by the resistors $R_1$ and $R_2$ and then to charge the capacitor C until the TFT $Q_1$ is turned on. Then, after the TFT $Q_1$ is turned on, the TFT Q2 is turned on accordingly. Thus, the first power VDDG is provided to the gate driving circuit 13 for use.

In accordance with above description, the gate driving circuit 13 receives the second power VEEG firstly and receives the first power VDDG thereafter, by which the conventional approach employs the delay circuit 12 for avoiding the first power VDDG to be provided prior to the second power VEEG so as to prevent the gate driving circuit 13 from being suddenly burned. However, although the delay circuit 12 is workable, the employment of which has increased production cost and destroyed competence of the products.

Further, other delay circuits 12 are also proposed by engineers in the art. For example, U.S. Pat. No. 6,373,479 discloses a "Power supply apparatus of an LCD and voltage sequence control method", in which one TFT and two resistors are disposed between the gate driving circuit and the power supply apparatus, so as to prevent the gate driving circuit 13 from being suddenly burned. Furthermore, in similar manner, U.S. Pat. No. 7,015,904 discloses a "Power sequence apparatus for device driving circuit and its method", and U.S. patent publication No. 2006/0092883 discloses a "Power sequence apparatus and driving method thereof".

However, all of the above mentioned technologies emphasized on protecting the gate driving circuit. They are incapable to minimizing the size of the product using the gate driving circuit. Also, they require extra power supplies or power sources, which add production cost. Further, the most important role is the foregoing technologies are not suitable for integrating with the gate driver as a gate driving circuit or designing the gate driver on a chipset.

SUMMARY OF THE INVENTION

Accordingly, the present invention is directed to a power control circuit for protecting a gate driving circuit, as well as minimizing a size of the circuit without additional power supplies or power sources.

The present invention is directed to a gate driving circuit comprising the power control circuit and a gate driver integrated to form a chipset having all the advantages of the power control circuit.

According to an embodiment of the present invention, the power control circuit is employed for controlling the gate driver. The gate driver is adapted for receiving a starting signal processed by an external power supply, and outputting a plurality of scan signals accordingly. The power control circuit includes a delay circuit, a level shifter and a switch unit. The delay circuit is adapted for receiving the starting signal, and delaying the starting signal for a predetermined period and outputting the delayed starting signal. The level shifter is coupled to the delay circuit for receiving and adjusting a voltage level of the delayed starting signal so as to output a starting voltage. The switch unit has a control terminal coupled to the level shifter, an input terminal for receiving the first power, and an output terminal coupled to the gate driving circuit. The input terminal and output terminal of the switch unit are determined to be turned on or turned off by the starting voltage.

According to another aspect of the present invention, a gate driving circuit is provided. The gate driving circuit includes a gate driver and a power control circuit. The gate driver receives a starting signal processed by an external power supply, and outputs a plurality of scan signals in sequence accordingly. The power control circuit includes a delay circuit, a level shifter and a switch unit. The delay circuit is adapted for receiving the starting signal, and delaying the starting signal for a predetermined period and outputting the delayed starting signal. The level shifter is coupled to the delay circuit for receiving a voltage level of the delayed starting signal so as to output a starting voltage. The switch unit has a control terminal coupled to the level shifter, an input terminal for receiving the first power, and an output terminal coupled to the gate driver. The input terminal and output terminal of the switch unit are determined to be turned on or turned off by the starting voltage.

According to an embodiment of the present invention, the delay circuit comprises an inverter and a D flip-flop. The inverter is employed to receive and invert the starting signal, and delay the inverted starting signal for a predetermined period and thereafter output the starting signal which is delayed and inverted. The D flip-flop has a data input terminal for receiving the starting signal, and a clock input terminal coupled to the inverter. The D flip-flop is adapted for outputting the delayed starting signal according to the starting signal after being delayed for the predetermined period.

According to another embodiment of the present invention, the delay circuit includes a D flip-flop. The D flip-flop has a data input terminal for receiving an operation power, and a clock input terminal for receiving the starting signal. The D flip-flop outputs the delayed starting signal according to the starting signal after being delayed for the predetermined period.

According to another embodiment of the present invention, the switch unit includes a P-type transistor, an N-type transistor, and an inverter. A control terminal of the N-type transistor and an input terminal of the inverter are coupled to the level shifter. A control terminal of the P-type transistor is coupled to an output terminal of the inverter. A first terminal of the P-type transistor and the N-type transistor are used to receive the first power, and a second terminal of the P-type transistor and the N-type transistor is coupled to the gate driver.

According to another embodiment of the power control circuit of the present invention, the switch unit includes a P-type transistor or an N-type transistor. The switch unit has a control terminal coupled to the level shifter, a first terminal for receiving the first power, and a second terminal coupled to the gate driver.

The present invention provides a power control circuit. The power control circuit employs a delay circuit for receiving a starting signal, and a level shifter for adjusting a voltage level of the delayed starting signal outputted from the delay circuit, and a switch unit for providing a first power to the gate driver for use according to the starting voltage outputted from the level shifter. In such a way, the power control circuit of the present invention is not only employed for protecting the gate driver, but also employed to minimize the size of the circuit, so that the power control circuit of the present invention is easily integrated with the gate driver to form an integrated gate driving circuit or a chipset.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF THE EMBODIMENTS

Figure 1:
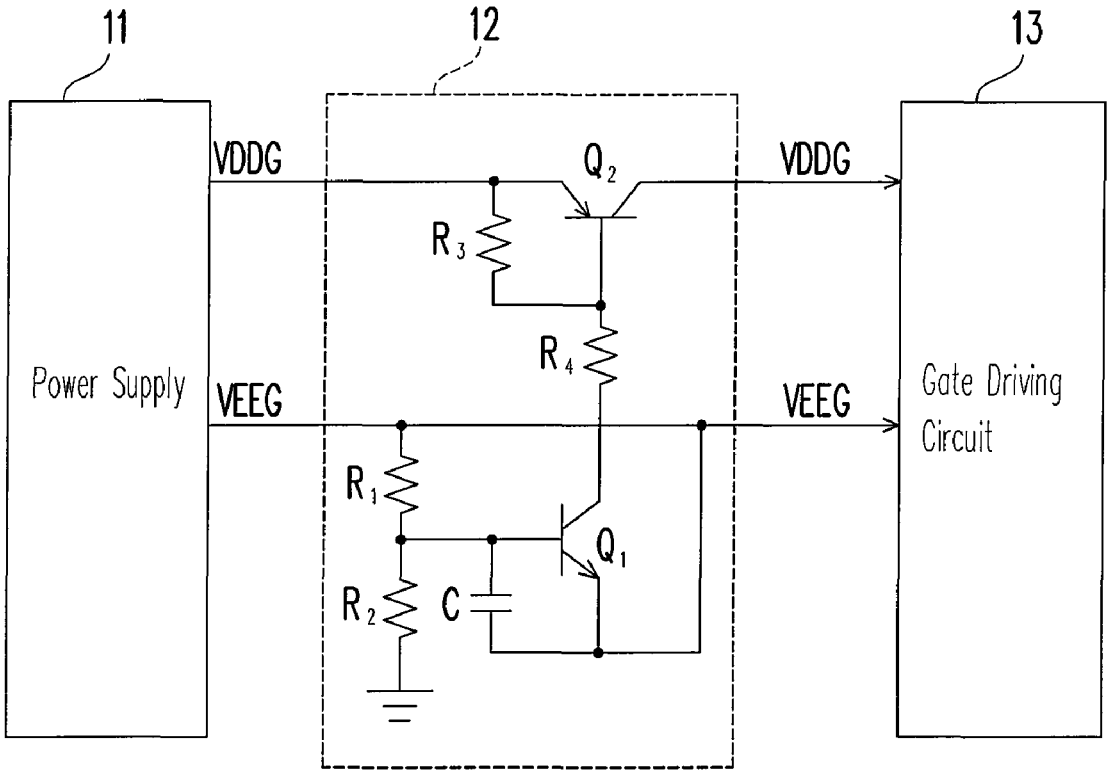
FIG. 1 (PRIOR ART)
FIG. 1 is a block diagram illustrating a conventional approach for protecting a gate driving circuit.
Figure 2:
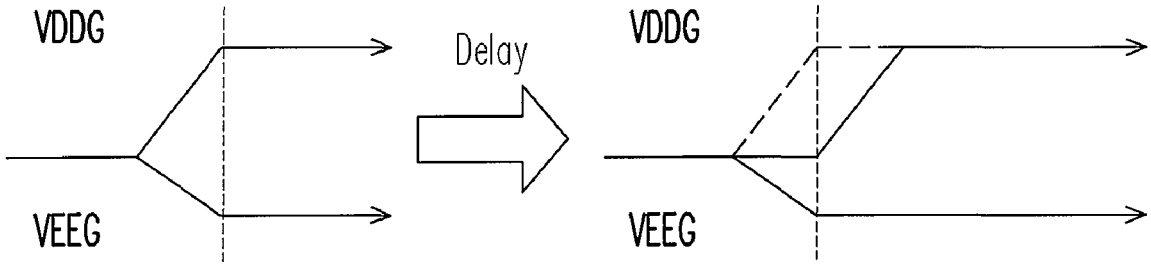
FIG. 2 (PRIOR ART)
FIG. 2 is power timing chart illustrating the powers received by the gate driving circuit as shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
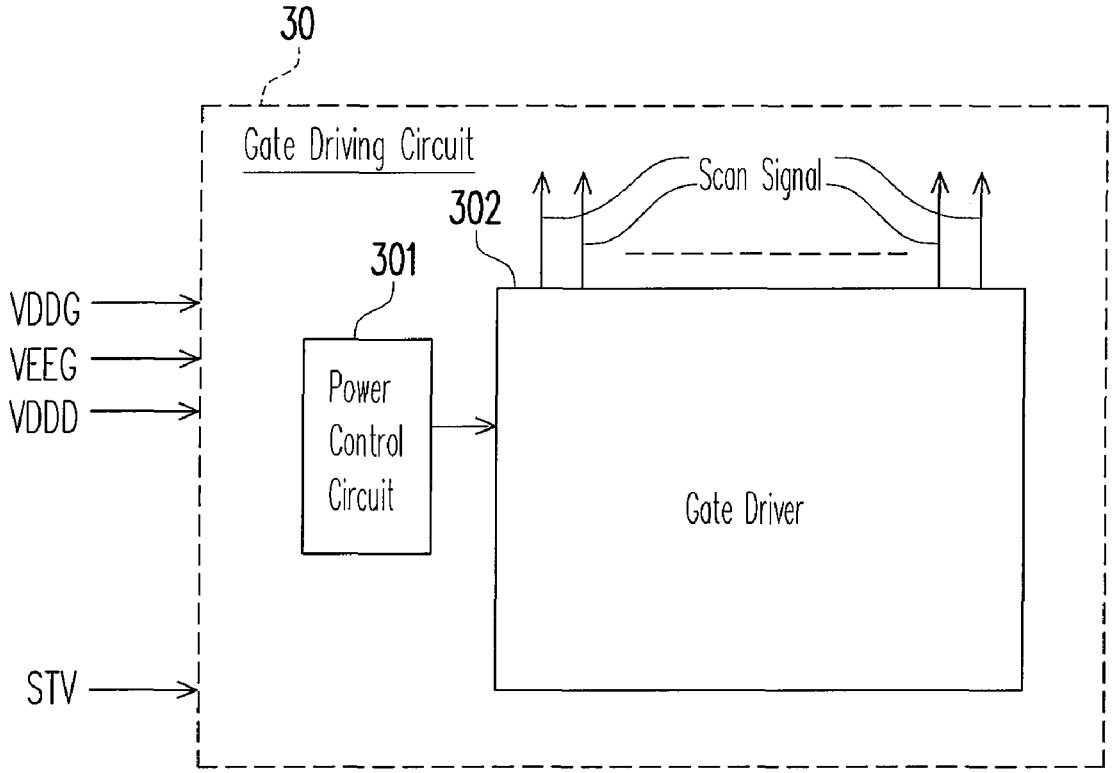
FIG. 3 is block diagram illustrating a gate driving circuit according to an embodiment of the present invention.

FIG. 3 is block diagram illustrating a gate driving circuit 30 according to an embodiment of the present invention. Referring to FIG. 3, the gate driving circuit 30 includes a power control circuit 301 and a gate driver 302. In the present embodiment, the gate driving circuit 30 is adapted for receiving a first power VDDG, a second power VEEG, an operation power VDDD, and a starting signal STV from an external power supply (not shown). The operation power VDDD provides an operation voltage to the gate driving circuit 30. The starting signal STV is a trigger signal for a scan signal outputted from the first scan line of the gate driver 302, triggered by which the gate driver 302 can output scan signals in sequence. In addition, the power control circuit 302 can be alternatively independent from the gate driving circuit 30.

The first power VDDG and the second power VEEG have been disclosed above, and can be learnt by referring to related art. The first power VDDG, the second power VEEG, the operation power VDDD, and the starting signal STV outputted from the external power supply should be well known to those of ordinary skill in the art and would not be iterated hereby.

Figure 4:
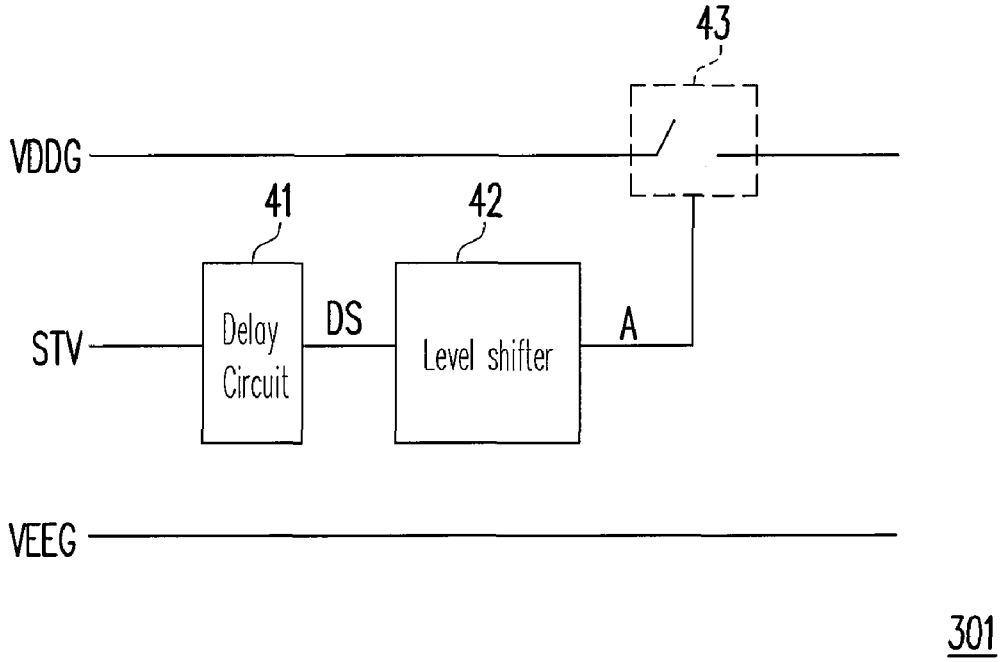
FIG. 4 is a block diagram illustrating the internal circuit of the power control circuit in FIG. 3.

FIG. 4 is a block diagram illustrating the internal circuit of the power control circuit in FIG. 3. Referring to FIGS. 3 and 4 together, the power control circuit 301 includes a delay circuit 41, a level shifter 42, and a switch unit 43. The delay circuit 41 is adapted for receiving the starting signal processed by the external power supply and delaying the starting signal STV for a predetermined period and then outputting the delayed starting signal DS. The level shifter 42 is adapted for receiving and adjusting a voltage level of the delayed starting signal DS outputted from the delay circuit 41, and outputting the same as a starting voltage A. A level of the starting voltage A is approximate to a voltage level of the first power VDDG, the reason for which is to be discussed later.

The switch unit 43 has an input terminal, an output terminal and a control terminal. The control terminal of the switch unit 43 is coupled to an output terminal of the level shifter 42. The input terminal of the switch unit 43 is adapted for receiving the first power VDDG from the external power supply. The output terminal of the switch unit 43 is coupled to the gate driver 302. In the embodiment, the switch unit 43 determines to conduct between the input terminal and the output terminal thereof according to the starting voltage A. In such a way, the power control circuit 301 can delay the first power for providing to the gate driver 302 according to the starting signal STV, so as to protect the gate driving circuit 30.

According to an embodiment of the present invention, the power control circuit 301 may be described below. However, it should be noted that the scope of the present invention is not limited thereto.

Figure 5:
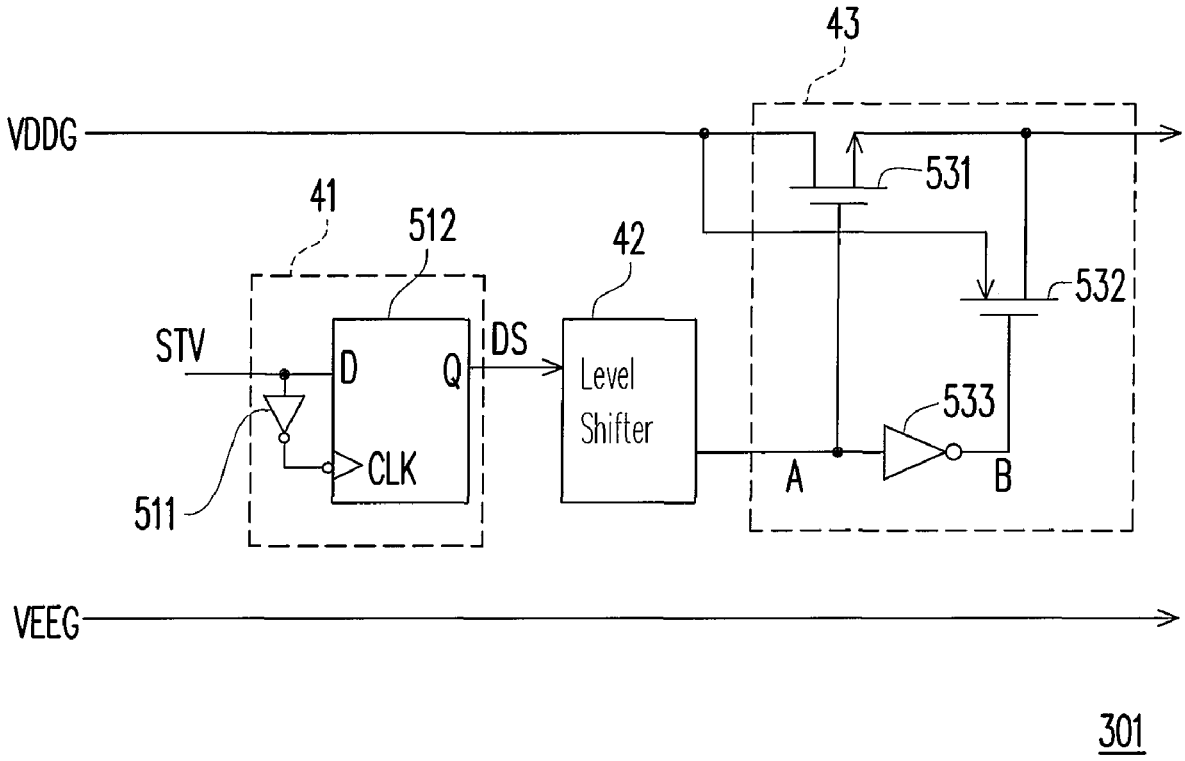
FIG. 5 is a circuit diagram of the power control circuit in FIG. 4.

FIG. 5 is a circuit diagram of the power control circuit in FIG. 4. Referring to FIGS. 4 and 5 together, the delay circuit 41 is composed of an inverter 511 and a negative edge triggering D flip-flop 512. The switch unit 43 is composed of an N-type transistor 531, a P-type transistor 532 and an inverter 533. The connection relationship of all components, i.e., the delay circuit 41, the level shifter 42 and the switch unit 43, inside the power control circuit 301 are configured as shown in FIG. 5, and thus it is omitted to describe herein.

Figure 6:
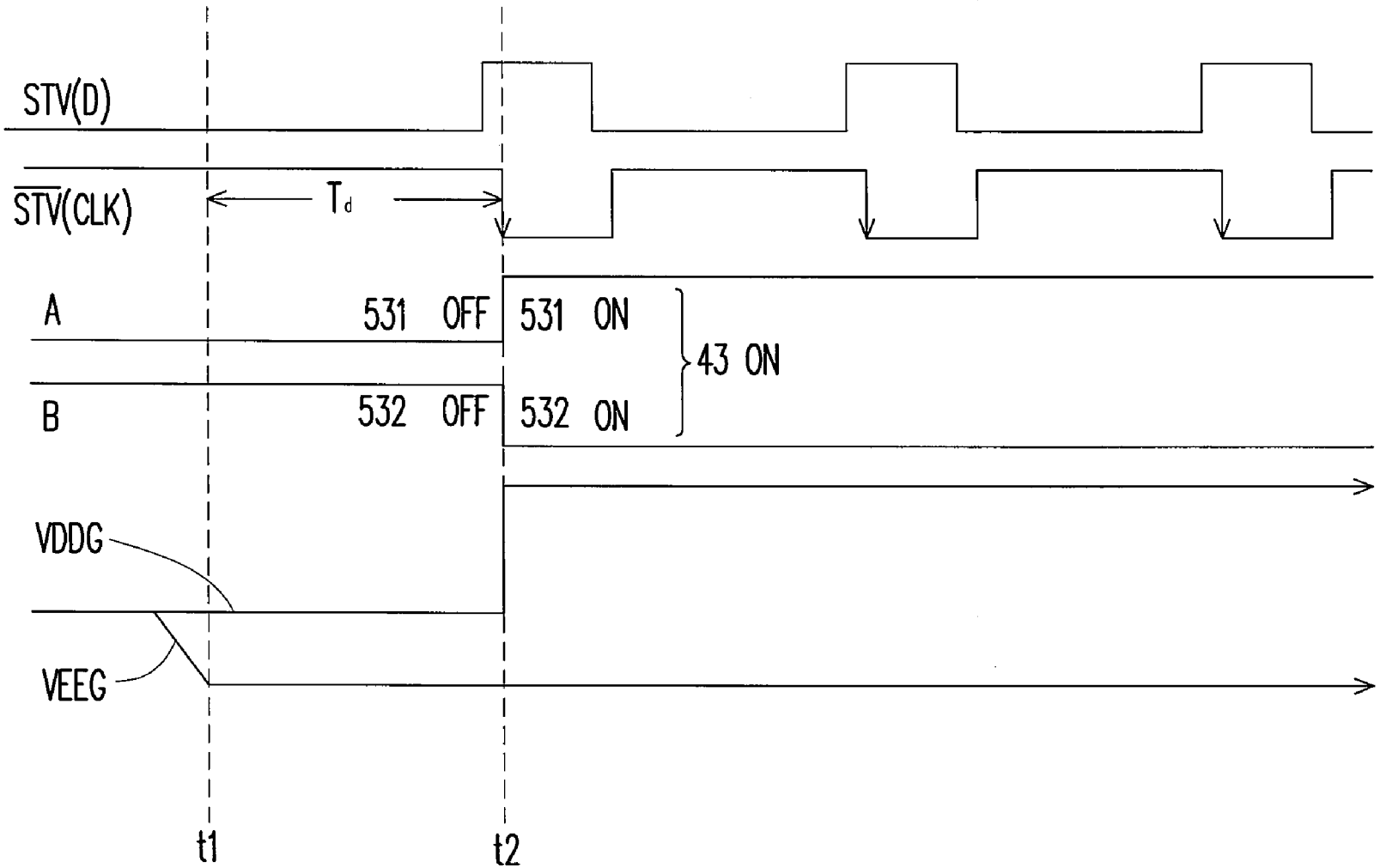
FIG. 6 is a power timing chart of the power control circuit in FIG. 5.

FIG. 6 is a power timing chart of the power control circuit in FIG. 5. Referring to FIGS. 3 through 6, in the present embodiment, when a data input terminal D of the D flip-flop 512 and an input terminal of the inverter 511 receive the starting signal STV, the inverter 511 inverts the starting signal STV, and thereafter delays the inverted starting signal and outputs to an clock input terminal CLK of the D flip-flop 512. As shown in FIG. 6, the starting signal STV received by the data input terminal of the D flip-flop 512 is marked with legend "STV(D)", and an inverted starting signal STV received by the clock input terminal of the D flip-flop is marked with a legend "$\overline{STV}$(CLK)".

As disclosed above, the D flip-flop 512 is by negative edge triggered, so that when the inverted starting signal $\overline{STV}$(CLK) is asserted from a high voltage to a low voltage, a data output terminal Q of the D flip-flop 512 outputs a high level starting signal STV(D), which is the delayed starting signal DS outputted from the delay circuit 41. Next, the level shifter 42 receives the delayed starting signal DS, and adjusts a level of the delayed starting signal DS to approximate to the voltage level of the first power VDDG, that is the starting voltage A outputted form the level shifter 42, by which a difference of voltages between the input terminal and output terminal of the switch unit 43 is decreased.

For example, assuming the first power VDDG is 18 volts, and the switch unit 43 has a very small thermal voltage, the starting voltage A can be preset as 18 volts, therefore after the switch unit 43 is turned on by the starting voltage A, the output terminal of the switch unit 43 can output a voltage approximate to 18V.

Next, when the input terminal of the inverter 533 receives the starting voltage A, the output terminal of the inverter 533 receives an inverted starting voltage B. If the starting voltage A is at a high level, the N-type transistor 531 is then turned on, which is represented as 531 ON corresponding to time t2 as shown in FIG. 6. Meanwhile, the inverted starting voltage B is at a low level, and therefore the P-type transistor 532 is turned on accordingly, which is represented as 532 ON corresponding to time t2 as shown in FIG. 6. Furthermore, when the N-type transistor 531 and the P-type transistor 532 are all turned on, the switch unit 43 are turned on for conduction, which is represented as 43 ON as shown in FIG. 6.

According to an aspect of the embodiment, the switch unit 43 is a complementary switch for decreasing a voltage difference between the input terminal and the output terminal of the switch unit 43. As such, only when the switch unit 43 is turned on, i.e., at time t2 shown in FIG. 6, the power control circuit 301 provides the first power VDDG to the gate driver 302 for use, by which the first power VDDG is delayed to output for a time $T_d$ as shown in FIG. 6. In such a way, the gate driver 302 receives the second power VEEG prior to the first power VDDG, by which the gate driving circuit 30 can be prevented from being suddenly burnt out.

Moreover, those of ordinary skill in the art would understand that optionally a single P-type transistor or a single N-type transistor can be used for substituting the switch unit 43. For example, when a single N-type transistor is used for realizing the switch unit 43, it is applicable to couple the control terminal of the N-type transistor 531 to the output terminal of the level shifter 42, use a first terminal of the N-type transistor 531 to receive the first power VDDG, and couple a second terminal of the N-type transistor 531 to the gate driver 302. In this way, when the starting voltage A is at a high level, the N-type transistor 531 is turned on, and the first power VDDG is provided to the gate driver 302 for use.

In addition, when a single P-type transistor is used for realizing the switch unit 43, it is applicable to couple the control terminal of the P-type transistor 532 to the output terminal of the level shifter 42, use a first terminal of the P-type transistor 532 to receive the first power VDDG, and couple a second terminal of the P-type transistor 532 to the gate driver 302. In this way, when the starting voltage A is at a low level, the P-type transistor 532 is turned on, and the first power VDDG is provided to the gate driver 302 for use.

Furthermore, the delay circuit 41 also has some other feasible options. For example, the inverter 511 can be replaced with a retarder. The retarder incorporated with a positive edge triggering D flip-flop 512 can also realize a similar performance of the delay circuit 41. In addition, a counter can also be used as an approach to control the predetermined time for delaying the first power VDDG. Manufacturers are often flexible to select different design of the delay circuit 41 and the switch unit 43. Accordingly, the present invention does not set forth any limitation of selection thereof. In other words, the spirit of the present invention is applied if only the delay circuit 41 delays the received starting signal STV for outputting a delayed starting signal DS, and then the switch unit 43 is controlled to turned on/off for providing the first power VDDG to the gate driver 302.

Figure 7:
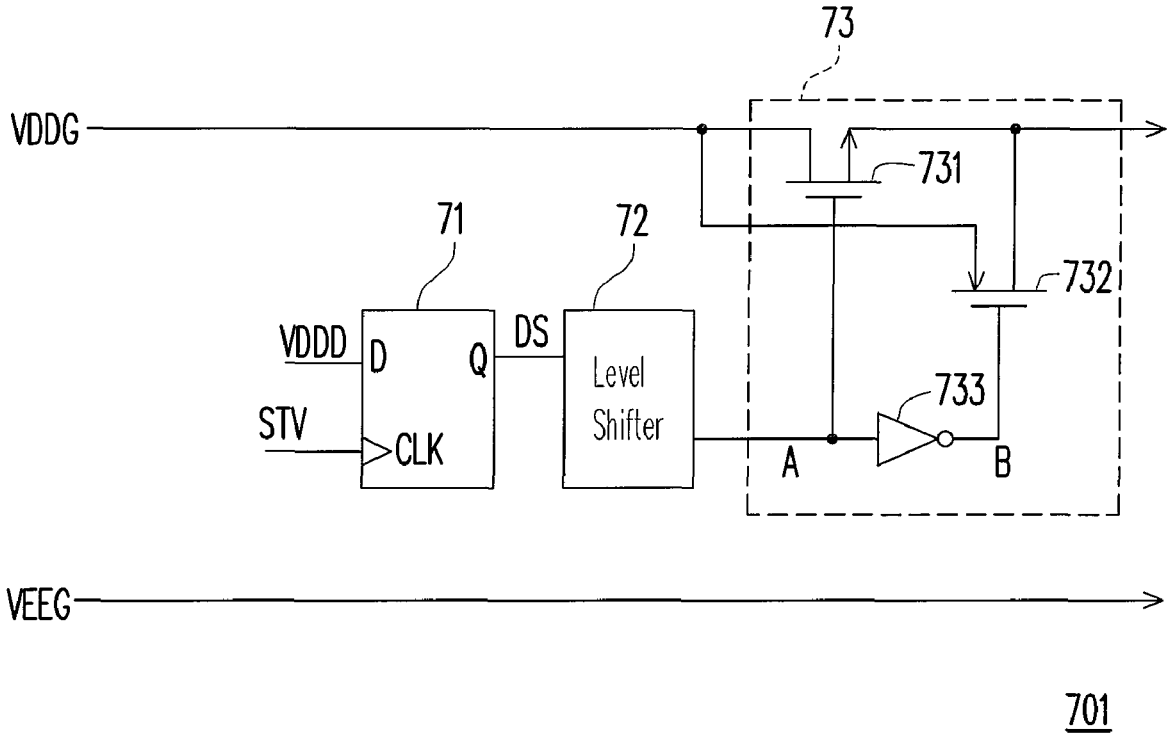
FIG. 7 is a block diagram illustrating a gate driving circuit according to another embodiment of the present invention.

FIG. 7 is a block diagram illustrating a gate driving circuit according to another embodiment of the present invention. Referring to FIGS. 5 and 7 together, a major difference between a power control circuit 701 and the power control circuit 301 is that the power control circuit 701 uses positive edge triggering D flip-flop 71 for realizing functions of the delay circuit 41 of FIG. 5. As shown in FIG. 7, a data input terminal D of the D flip-flop 71 receives the operation power VDDD, which is marked as VDDD(D) in FIG. 8, while a clock input terminal CLK receives the starting signal STV (CLK).

Figure 8:
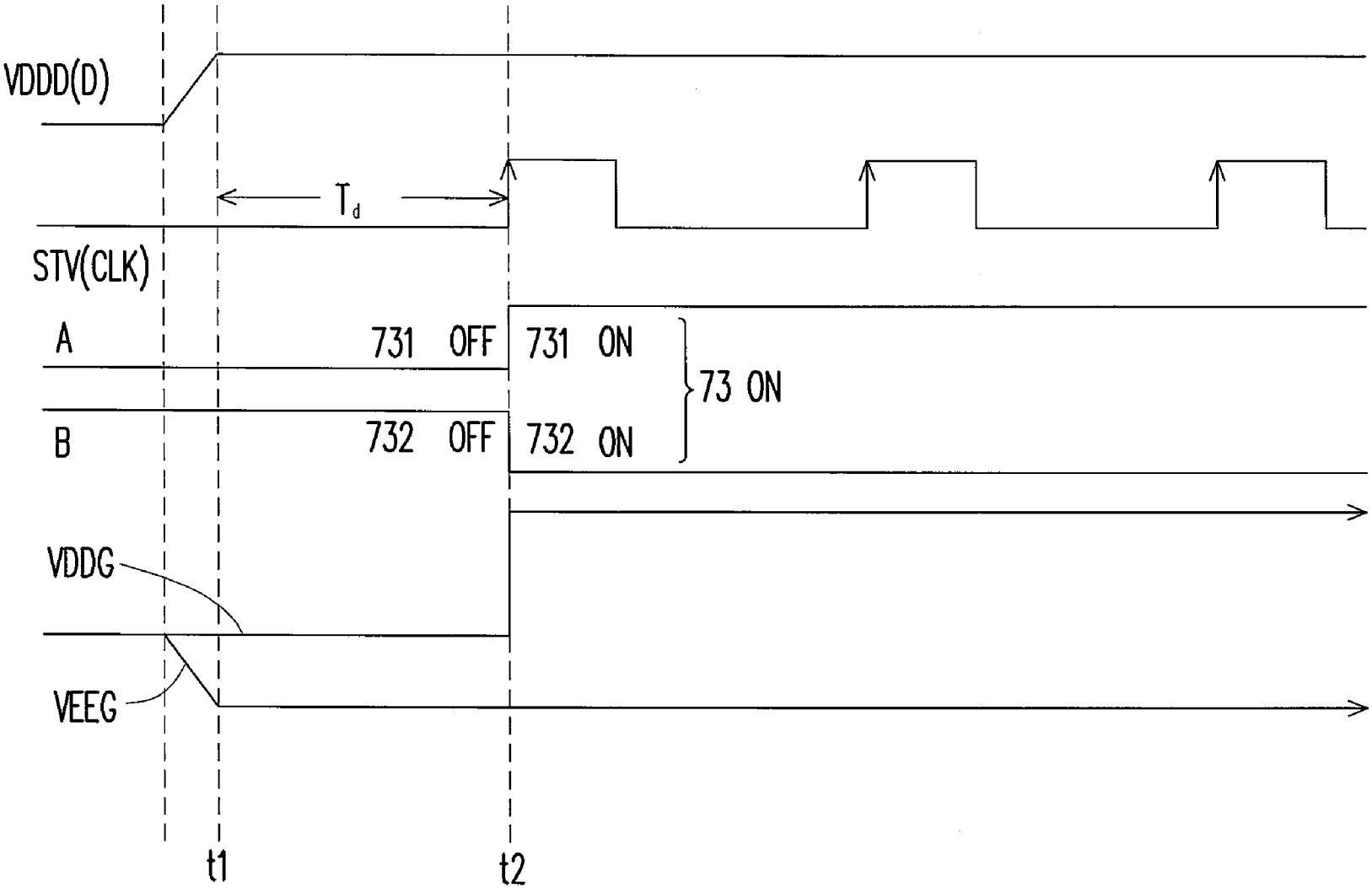
FIG. 8 is a power timing chart of the power control circuit in FIG. 7.

FIG. 8 is a power timing chart of the power control circuit in FIG. 7. Referring to FIGS. 3, 7 and 8 together, at time t1, the external power supply simultaneously outputs the first power VDDG, the second power VEEG, the starting signal STV, and the operation power VDDD. The second power VEEG is directly provided to the gate driver 302. Next, at time t2, when the operation power VDDD and the starting signal STV received respectively by the data input terminal and the clock input terminal of the D flip-flop 71 are all at a high level, the switch unit 73 turns on to conduct the input terminal and the output terminal thereof, and delays the first power for a time $T_d$ as shown in FIG. 8, and provides the delayed first power VDDG to the gate driver 302 for use. Other details of the embodiment are similar to the embodiment as discussed according to FIG. 5, and are not to be iterated hereby.

In summary, the present invention provides a power control circuit. The power control circuit employs a delay circuit for receiving a starting signal, and a level shifter for adjusting a voltage level of a delayed starting signal outputted from the delay circuit, and a switch unit for providing a first power to the gate driver for use according to the starting voltage outputted from the level shifter. In such a way, the power control circuit according to the present invention is not only adapted for protecting the gate driver, but also adapted to minimize the size of the circuit, so that the power control circuit in this manner is adapted for integration with the gate driver to be an integrated gate driving circuit or integrated together with a gate driver in a chipset.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A power control circuit for controlling a gate driver, the gate driver receiving a starting signal processed by a external power supply and outputting a plurality of scan signals in sequence accordingly, the power control circuit comprising:

a delay circuit, for receiving and delaying the starting signal for a predetermined period and then outputting a delayed starting signal;

a level shifter, coupled to the delay circuit, for receiving and adjusting a voltage level of the delayed starting signal so as to output a starting voltage; and a switch unit, having a control terminal coupled to the level shifter, an input terminal for receiving a first power, and an output terminal coupled to the gate driving circuit, wherein the input terminal and output terminal of the switch unit are determined to be turned on or turned off by the starting voltage.

2. The power control circuit according to claim 1, wherein the delay circuit comprises:

an inverter, for receiving and inverting the starting signal, and delaying the inverted starting signal for the predetermined period and thereafter outputting the delayed inverted starting signal; and a D flip-flop, having a data input terminal for receiving the starting signal, and a clock input terminal coupled to the inverter, wherein the D flip-flop outputs the delayed starting signal according to the starting signal after being delayed for the predetermined period.

3. The power control circuit according to claim 1, wherein the delay circuit comprises a D flip-flop having a data input terminal for receiving an operation power and a clock input terminal for receiving the starting signal, wherein the D flip-flop outputs the delayed starting signal according to the starting signal after being delayed for the predetermined period.

4. The power control circuit according to claim 1, wherein the switch unit comprises:

a P-type transistor;

an N-type transistor; and an inverter, wherein a control terminal of the N-type transistor and an input terminal of the inverter are coupled to the level shifter; a control terminal of the P-type transistor is coupled to an output terminal of the inverter; each of the P-type transistor and the N-type transistor comprises a first terminal for receiving the first power and a second terminal coupled to the gate driver.

5. The power control circuit according to claim 1, wherein the switch unit comprises a P-type transistor having a control terminal coupled to the level shifter, a first terminal for receiving the first power, and a second terminal coupled to the gate driver.

6. The power control circuit according to claim 1, wherein the switch unit comprises an N-type transistor having a control terminal coupled to the level shifter, a first terminal for receiving the first power, and a second terminal coupled to the gate driver.

7. A gate driving circuit, comprising:

a gate driver, for receiving a starting signal and sequentially outputting a plurality of scan signals accordingly; and a power control circuit, comprising:

a delay circuit, for receiving and delaying the starting signal for a predetermined period and then outputting the delayed starting signal;

a level shifter, coupled to the delay circuit, for receiving and adjusting a voltage level of the delayed starting signal so as to output a starting voltage; and a switch unit, having a control terminal coupled to the level shifter, an input terminal for receiving a first power and an output terminal coupled to the gate driving circuit, wherein the input terminal and output terminal of the switch unit are determined to be turned on or turned off by the starting voltage.

8. The gate driving circuit according to claim 7, wherein the delay circuit comprises:

an inverter, for receiving and inverting the starting signal, and delaying the inverted starting signal for the predetermined period and thereafter outputting the delayed inverted starting signal; and a D flip-flop, having a data input terminal for receiving the starting signal, a clock input terminal coupled to the inverter, wherein the D flip-flop outputs the delayed starting signal according to the starting signal after being delayed for the predetermined period.

9. The gate driving circuit according to claim 7, wherein the delay circuit comprises a D flip-flop having a data input terminal for receiving an operation power, a clock input terminal for receiving the starting signal, wherein the D flip-flop outputs the delayed starting signal according to the starting signal after being delayed for the predetermined period.

10. The gate driving circuit according to claim 7, wherein the switch unit comprises:

a P-type transistor;

an N-type transistor; and an inverter, wherein a control terminal of the N-type transistor and an input terminal of the inverter are coupled to the level shifter; a control terminal of the P-type transistor is coupled to an output terminal of the inverter; each of the P-type transistor and the N-type transistor comprises a first terminal for receiving the first power, and a second terminal coupled to the gate driver.

11. The gate driving circuit according to claim 7, wherein the switch unit comprises a P-type transistor having a control terminal coupled to the level shifter, a first terminal for receiving the first power, and a second terminal coupled to the gate driver.

12. The gate driving circuit according to claim 7, wherein the switch comprises an N-type transistor having a control terminal coupled to the level shifter, a first terminal for receiving the first power, and a second terminal coupled to the gate driver.

* * * * *